US012291766B2

(12) United States Patent
Kamo et al.

(10) Patent No.: US 12,291,766 B2
(45) Date of Patent: May 6, 2025

(54) STAINLESS STEEL SEAMLESS PIPE AND METHOD FOR MANUFACTURING SAME

(71) Applicant: JFE STEEL CORPORATION, Tokyo (JP)

(72) Inventors: Yuichi Kamo, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 479 days.

(21) Appl. No.: 17/764,649

(22) PCT Filed: Aug. 27, 2020

(86) PCT No.: PCT/JP2020/032406
§ 371 (c)(1),
(2) Date: Mar. 29, 2022

(87) PCT Pub. No.: WO2021/065262
PCT Pub. Date: Apr. 8, 2021

(65) Prior Publication Data

US 2022/0349036 A1 Nov. 3, 2022

(30) Foreign Application Priority Data

Oct. 1, 2019 (JP) ..... 2019-181341

(51) Int. Cl.

| | |
|---|---|
| ***C22C 38/48*** | (2006.01) |
| ***C21D 8/10*** | (2006.01) |
| ***C21D 9/08*** | (2006.01) |
| ***C22C 38/12*** | (2006.01) |
| ***C22C 38/42*** | (2006.01) |
| ***C22C 38/44*** | (2006.01) |
| ***C22C 38/46*** | (2006.01) |

(52) U.S. Cl.
CPC ..... *C22C 38/48* (2013.01); *C21D 8/105* (2013.01); *C21D 9/085* (2013.01); *C22C 38/12* (2013.01); *C22C 38/42* (2013.01); *C22C 38/44* (2013.01); *C22C 38/46* (2013.01); *C21D 2211/001* (2013.01); *C21D 2211/005* (2013.01); *C21D 2211/008* (2013.01)

(58) Field of Classification Search
CPC ..... C22C 38/48; C22C 38/12; C22C 38/42; C22C 38/44; C22C 38/46; C22C 38/001; C22C 38/002; C22C 38/005; C22C 38/52; C22C 38/004; C22C 38/008; C22C 38/02; C22C 38/04; C22C 38/06; C22C 38/50; C22C 38/54; C22C 38/60; C21D 8/105; C21D 9/085; C21D 2211/001; C21D 2211/005; C21D 2211/008; C21D 1/18; C21D 1/25; C21D 6/004; C21D 9/08
See application file for complete search history.

(56) References Cited

FOREIGN PATENT DOCUMENTS

| | | | |
|---|---|---|---|
| CN | 106756605 | A | 5/2017 |
| EP | 3 321 389 | A1 | 5/2018 |
| EP | 3 333 276 | A1 | 6/2018 |
| EP | 3 569 724 | A1 | 11/2019 |
| EP | 3 670 693 | A1 | 6/2020 |
| JP | 2014-43595 | A | 3/2014 |
| JP | 2017-39966 | A | 2/2017 |
| WO | 2016/079920 | A1 | 5/2016 |
| WO | 2017/138050 | A1 | 8/2017 |
| WO | 2018/020886 | A1 | 2/2018 |
| WO | 2018/131340 | A1 | 7/2018 |
| WO | 2018/155041 | A1 | 8/2018 |
| WO | 2019/035329 | A1 | 2/2019 |

OTHER PUBLICATIONS

WO2017138050A1 English language translation (Year: 2017).*
Jul. 25, 2022 Office Action issued in Chinese Patent Application No. 202080068217.X.
Nov. 17, 2020 International Search Report issued in International Application No. PCT/JP2020/032406.
Dec. 22, 2022 Office Action issued in Chinese Patent Application No. 202020068217.X.
Jul. 26, 2023 Office Action issued in Chinese Patent Application No. 202080068217.X.
Sep. 8, 2022 Office Action issued in European Patent Application No. 20871757.9.

* cited by examiner

*Primary Examiner* — Ricardo D Morales
(74) *Attorney, Agent, or Firm* — Oliff PLC

(57) ABSTRACT

A stainless steel seamless pipe having high strength and excellent corrosion resistance, and a method for producing the same. The stainless steel seamless pipe has a specified composition and satisfies a predetermined formula. The stainless steel seamless pipe has a microstructure containing at least 30% martensitic phase, at most 60% ferrite phase, and at most 40% retained austenite phase by volume, the stainless steel seamless pipe having a yield strength of 758 MPa or more.

16 Claims, No Drawings

STAINLESS STEEL SEAMLESS PIPE AND METHOD FOR MANUFACTURING SAME

TECHNICAL FIELD

This application relates to a martensitic stainless steel seamless pipe suited for oil country tubular goods for oil wells and gas wells (hereinafter, referred to simply as "oil wells"). Particularly, this application relates to improvement of corrosion resistance in various corrosive environments such as a severe high-temperature corrosive environment containing carbon dioxide ($CO_2$) and chlorine ions ($Cl^-$), and a hydrogen sulfide ($H_2S$)-containing environment.

BACKGROUND

An expected shortage of energy resources in the near future has prompted active development of oil wells that were unthinkable in the past, for example, such as those in deep oil fields, a carbon dioxide gas-containing environment, and a hydrogen sulfide-containing environment, or a sour environment as it is also called. The steel pipes for oil country tubular goods intended for these environments require high strength and excellent corrosion resistance.

Oil country tubular goods used for mining of oil fields and gas fields in environments containing $CO_2$, $Cl^-$, and the like typically use 13Cr martensitic stainless steel pipes. There has also been development of oil wells at higher temperatures (a temperature as high as 200° C.). However, the corrosion resistance of 13Cr martensitic stainless steel is not always sufficient for such applications. Accordingly, there is a need for a steel pipe for oil country tubular goods that shows excellent corrosion resistance even when used in such environments.

In connection with such a demand, for example, PTL 1 describes a martensitic stainless steel comprising, in mass %, C: 0.005 to 0.05%, Si: 1.0% or less, Mn: 2.0% or less, Cr: 16 to 18%, Ni: 2.5 to 6.5%, Mo: 1.5 to 3.5%, W: 3.5% or less, Cu: 3.5% or less, V: 0.01 to 0.08%, Sol.Al: 0.005 to 0.10%, N: 0.05% or less, and Ta: 0.01 to 0.06%.

PTL 2 describes a high-strength stainless steel seamless pipe for oil country tubular goods having a composition that comprises, in mass %, C: 0.05% or less, Si: 1.0% or less, Mn: 0.1 to 0.5%, P: 0.05% or less, S: less than 0.005%, Cr: more than 15.0% and 19.0% or less, Mo: more than 2.0% and 3.0% or less, Cu: 0.3 to 3.5%, Ni: 3.0% or more and less than 5.0%, W: 0.1 to 3.0%, Nb: 0.07 to 0.5%, V: 0.01 to 0.5%, Al: 0.001 to 0.1%, N: 0.010 to 0.100%, and O: 0.01% or less, and in which Nb, Ta, C, N, and Cu satisfy a specific relationship, and having a microstructure that contains at least 45% tempered martensitic phase, 20 to 40% ferrite phase, and more than 10% and at most 25% retained austenite phase by volume.

PTL 3 describes a high-strength stainless steel seamless pipe for oil country tubular goods having a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, and N: 0.15% or less, and in which C, Si, Mn, Cr, Ni, Mo, Cu, N, and W satisfy specific relationships, and having a microstructure that contains more than 45% martensitic phase as a primary phase, 10 to 45% ferrite phase and at most 30% retained austenite phase as a secondary phase, by volume.

PTL 4 describes a high-strength stainless steel seamless pipe for oil country tubular goods having a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, and B: 0.0005 to 0.0100%, and in which C, Si, Mn, Cr, Ni, Mo, Cu, N, and W satisfy specific relationships, and having a microstructure that contains more than 45% martensitic phase as a primary phase, 10 to 45% ferrite phase and at most 30% retained austenite phase as a secondary phase, by volume.

CITATION LIST

Patent Literature

PTL 1: JP-A-2014-43595
PTL 2: WO2017/138050
PTL 3: WO2018/020886
PTL 4: WO2018/155041

SUMMARY

Technical Problem

It is stated in the foregoing PTL 1 to PTL 4 that the techniques described in these documents can produce a steel pipe having desirable sulfide stress cracking resistance with no cracks occurring in a test specimen after a test conducted by immersing a test specimen in a test solution (a 20 mass % NaCl aqueous solution; liquid temperature of 25° C.; an atmosphere of 0.9 atm $CO_2$ and 0.1 atm $H_2S$) kept in an autoclave and having an adjusted pH of 3.5 with addition of acetic acid and sodium acetate, and applying a stress equal to 90% of the yield stress for 720 hours in the solution. The test uses a round rod-shaped test specimen that complies with NACE TM0177, Method A, and determines the sulfide stress cracking resistance by the presence or absence of cracking at an elapsed time of 720 hours after the test specimen is placed under a constant load, and exposed to a specific corrosive environment (hereinafter, the test will be referred to as "constant load test"). Recently, a test called "ripple load test" (or "cyclic SSRT" or "ripple SSRT"; hereinafter, referred to as "RLT test") has also come to be used for the evaluation of sulfide stress cracking resistance. A notable difference between constant load test and RLT test is that the applied stress is always constant in the constant load test, whereas the RLT test applies varying stresses throughout the test. The performance of the steel pipes produced using the techniques described in PTL 1 to PTL 4 cannot be said as being satisfactory when evaluated in an RLT test conducted with an aqueous solution (a 20 mass % NaCl aqueous solution; liquid temperature of 25° C.; an atmosphere of 0.9 atm $CO_2$ and 0.1 atm $H_2S$) having an adjusted pH of 3.5 with addition of acetic acid and sodium acetate. That is, there is a demand for improved sulfide stress cracking resistance in recent years.

Adding corrosion-resistant elements such as Cr and Mo is effective at improving sulfide stress cracking resistance. However, increasing the amounts of these elements lowers the Ms point, a temperature at which martensitic transformation starts to occur. Studies by the present inventors revealed that high strength with a yield strength of 758 MPa (110 ksi) or more, and desirable sulfide stress cracking resistance cannot be achieved by simply adjusting Cr and Mo contents.

The disclosed embodiments are intended to provide a solution to the above-described problems, and it is an object of the disclosed embodiments to provide a stainless steel seamless pipe having excellent corrosion resistance, and high strength with a yield strength of 758 MPa (110 ksi) or more. Another object of the disclosed embodiments are to provide a method for manufacturing such a stainless steel seamless pipe.

As used herein, "excellent corrosion resistance" means "excellent carbon dioxide gas corrosion resistance" and "excellent sulfide stress cracking resistance".

As used herein, "excellent carbon dioxide gas corrosion resistance" means that a test specimen immersed in a test solution (a 20 mass % NaCl aqueous solution; a liquid temperature of 200° C.; an atmosphere of 30 atm $CO_2$ gas) kept in an autoclave has a corrosion rate of 0.127 mm/y or less after 336 hours in the solution.

As used herein, "excellent sulfide stress cracking resistance (SSC resistance)" means that a test specimen immersed in a test solution (a 20 mass % NaCl aqueous solution; liquid temperature: 25° C.; an atmosphere of 0.9 atm $CO_2$ gas and 0.1 atm $H_2S$) kept in an autoclave and having an adjusted pH of 3.5 with addition of acetic acid and sodium acetate does not break or crack after a test (RLT test) conducted by repeatedly increasing and decreasing stress at a strain rate of $1\times10^{-6}$/s and a strain rate of $5\times10^{-6}$/s, respectively, for 1 week between 100% yield stress and 80% yield stress.

Solution to Problem

In order to achieve the foregoing objects, the present inventors conducted intensive investigations of various factors that affect the strength and corrosion resistance of a stainless steel pipe. The studies found that high strength and excellent corrosion resistance can be obtained by adding 0.001% to 0.3% Ta, in addition to 0.01% to 0.5% V. The present inventors have developed possible explanations for this finding, as follows.

Some corrosion resistant elements, for example, Cr and Mo, form compounds with the carbon in the steel. Cr and Mo that have formed compounds with carbon are no longer able to exhibit their effect as corrosion resistant elements. By adding Ta in addition to V, these elements appear to form carbides more preferentially than Cr and Mo, and enable Cr and Mo to improve sulfide stress cracking resistance by increasing the amounts of Cr and Mo, which effectively act on corrosion resistance in steel. The carbides formed by V and Ta also appear to improve strength through precipitation, as evidenced by the observed high strength with a yield strength of 758 MPa (110 ksi) or more.

The disclosed embodiments were completed after further studies based on these findings. Specifically, the gist of the disclosed embodiments is as follows.

[1] A stainless steel seamless pipe having a composition that includes, in mass %, C: 0.06% or less,
Si: 1.0% or less,
P: 0.05% or less,
S: 0.005% or less,
Cr: more than 15.8% and 18.0% or less,
Mo: 1.8% or more and 3.5% or less,
Cu: more than 1.5% and 3.5% or less,
Ni: 2.5% or more and 6.0% or less,
V: 0.01% or more and 0.5% or less,
Al: 0.10% or less,
N: 0.10% or less,
O: 0.010% or less, and
Ta: 0.001% or more and 0.3% or less, and in which C, Si, Mn, Cr, Ni, Mo, Cu, and N satisfy the following formula (1), and the balance is Fe and incidental impurities, the stainless steel seamless pipe having a microstructure containing at least 30% martensitic phase, at most 60% ferrite phase, and at most 40% retained austenite phase by volume, the stainless steel seamless pipe having a yield strength of 758 MPa or more, $$13.0\leq-5.9\times(7.82+27C-0.91Si+0.21Mn-0.9Cr+Ni-1.1Mo+0.2Cu+11N)\leq50.0 \quad (1),$$

wherein C, Si, Mn, Cr, Ni, Mo, Cu, and N represent the content of each element in mass %, and the content is 0 (zero; mass %) for elements that are not contained.

[2] The stainless steel seamless pipe according to [1], wherein the composition further includes, in mass %, Mn: 1.0% or less.

[3] The stainless steel seamless pipe according to [1] or [2], wherein the stainless steel seamless pipe of the composition in [1] or [2] has a microstructure containing at least 40% martensitic phase, at most 60% ferrite phase, and at most 30% retained austenite phase by volume, and has a yield strength of 862 MPa or more.

[4] The stainless steel seamless pipe according to any one of [1] to [3], wherein the composition further includes, in mass %, one or two or more selected from W: 3.0% or less,
B: 0.01% or less, and
Nb: 0.30% or less.

[5] The stainless steel seamless pipe according to any one of [1] to [4], wherein the composition further includes, in mass %, one or two or more selected from Ti: 0.3% or less,
Zr: 0.3% or less, and
Co: 1.5% or less.

[6] The stainless steel seamless pipe according to any one of [1] to [5], wherein the composition further includes, in mass %, one or two or more selected from Ca: 0.01% or less,
REM: 0.3% or less,
Mg: 0.01% or less,
Sn: 0.2% or less, and
Sb: 1.0% or less.

[7] A method for manufacturing the stainless steel seamless pipe of any one of [1] to [6], the method including:

forming a seamless steel pipe of predetermined dimensions from a steel pipe material;

quenching that heats the seamless steel pipe to a temperature ranging from 850 to 1, 150° C., and cools the seamless steel pipe to a surface temperature of 50° C. or less at a cooling rate of air cooling or faster; and tempering that heats the quenched seamless steel pipe to a temperature of 500 to 650° C.

Advantageous Effects

The disclosed embodiments can provide a stainless steel seamless pipe having excellent corrosion resistance, and high strength with a yield strength of 758 MPa (110 ksi) or more.

DETAILED DESCRIPTION

A stainless steel seamless pipe of the disclosed embodiments is a stainless steel seamless pipe having a composition that includes, in mass %, C: 0.06% or less, Si: 1.0% or less, P: 0.05% or less, S: 0.005% or less, Cr: more than 15.8% and 18.0% or less, Mo: 1.8% or more and 3.5% or less, Cu: more than 1.5% and 3.5% or less, Ni: 2.5% or more and 6.0% or less, V: 0.01% or more and 0.5% or less, Al: 0.10% or less, N: 0.10% or less, O: 0.010% or less, and Ta: 0.001% or more and 0.3% or less, and in which C, Si, Mn, Cr, Ni, Mo, Cu, and N satisfy the following formula (1), and the balance is Fe and incidental impurities, the stainless steel seamless pipe having a microstructure containing at least 30% martensitic phase, at most 60% ferrite phase, and at most 40% retained austenite phase by volume, the stainless steel seamless pipe having a yield strength of 758 MPa or more, $$13.0 \leq -5.9 \times (7.82 + 27C - 0.91Si + 0.21Mn - 0.9Cr + Ni - 1.1Mo + 0.2Cu + 11N) \leq 50.0 \quad (1),$$

wherein C, Si, Mn, Cr, Ni, Mo, Cu, and N represent the content of each element in mass %, and the content is 0 (zero; mass %) for elements that are not contained.

The following describes the reasons for specifying the composition of a seamless steel pipe of the disclosed embodiments. In the following, "%" means percent by mass, unless otherwise specifically stated.

C: 0.06% or Less

C is an element that becomes incidentally included in the process of steelmaking. Corrosion resistance decreases when C is contained in an amount of more than 0.06%. For this reason, the C content is 0.06% or less. The C content is preferably 0.05% or less, more preferably 0.04% or less. Considering the decarburization cost, the C content is preferably 0.002% or more, more preferably 0.003% or more.

Si: 1.0% or Less

Si is an element that acts as a deoxidizing agent. However, hot workability, corrosion resistance, and strength decrease when Si is contained in an amount of more than 1.0%. For this reason, the Si content is 1.0% or less. The Si content is preferably 0.7% or less, more preferably 0.5% or less. It is not particularly required to set a lower limit, as long as the deoxidizing effect is obtained. However, in order to obtain a sufficient deoxidizing effect, the Si content is preferably 0.03% or more, more preferably 0.05% or more.

P: 0.05% or Less

P is an element that impairs the corrosion resistance, including carbon dioxide gas corrosion resistance, and sulfide stress cracking resistance. P is therefore contained preferably in as small an amount as possible in the disclosed embodiments. However, a P content of 0.05% or less is acceptable. For this reason, the P content is 0.05% or less. The P content is preferably 0.04% or less, more preferably 0.03% or less.

S: 0.005% or Less

S is an element that seriously impairs hot workability, and interferes with stable operations of hot working in the pipe manufacturing process. S exists as sulfide inclusions in steel, and impairs the corrosion resistance. S should therefore be contained preferably in as small an amount as possible. However, a S content of 0.005% or less is acceptable. For this reason, the S content is 0.005% or less. The S content is preferably 0.004% or less, more preferably 0.003% or less.

Cr: More than 15.8% and 18.0% or Less

Cr is an element that forms a protective coating on steel pipe surface, and contributes to improving corrosion resistance. The desired corrosion resistance, particularly carbon dioxide gas corrosion resistance cannot be provided when the Cr content is 15.8% or less. For this reason, Cr needs to be contained in an amount of more than 15.8%. With a Cr content of more than 18.0%, the ferrite fraction and retained austenite fraction tend to overly increase, and the desired strength cannot be provided as a result of the martensite fraction falling below 30%. For this reason, the Cr content is more than 15.8% and 18.0% or less. The Cr content is preferably 16.0% or more, more preferably 16.3% or more. The Cr content is preferably 17.5% or less, more preferably 17.2% or less, further preferably 17.0% or less.

Mo: 1.8% or More and 3.5% or Less

By stabilizing the protective coating on steel pipe surface, Mo increases the resistance against pitting corrosion due to Cl and low pH, and increases the sulfide stress cracking resistance. Mo needs to be contained in an amount of 1.8% or more to obtain the desired corrosion resistance. The effect becomes saturated with a Mo content of more than 3.5%. For this reason, the Mo content is 1.8% or more and 3.5% or less. The Mo content is preferably 2.0% or more, more preferably 2.2% or more. The Mo content is preferably 3.3% or less, more preferably 3.0% or less, further preferably 2.8% or less, even more preferably less than 2.7%.

Cu: More than 1.5% and 3.5% or Less

Cu increases the retained austenite, and contributes to improving yield strength by forming a precipitate. This makes it possible to obtain high strength without decreasing low-temperature toughness. Cu also acts to reduce entry of hydrogen into steel by strengthening the protective coating on steel pipe surface, and improve the sulfide stress cracking resistance. Cu needs to be contained in an amount of more than 1.5% to obtain the desired strength and corrosion resistance, particularly carbon dioxide gas corrosion resistance. An excessively high Cu content results in decrease of hot workability of steel, and the Cu content is 3.5% or less. For this reason, the Cu content is more than 1.5% and 3.5% or less. The Cu content is preferably 1.8% or more, more preferably 2.0% or more. The Cu content is preferably 3.2% or less, more preferably 3.0% or less.

Ni: 2.5% or More and 6.0% or Less

Ni is an element that strengthens the protective coating on steel pipe surface, and contributes to improving corrosion resistance. By solid solution strengthening, Ni also increases the steel strength, and improves the toughness of steel. These effects become more pronounced when Ni is contained in an amount of 2.5% or more. A Ni content of more than 6.0% results in decrease of martensitic phase stability, and decreases the strength. For this reason, the Ni content is 2.5% or more and 6.0% or less. The Ni content is preferably 3.0% or more, more preferably more than 3.5%, further preferably 4.0% or more. The Ni content is preferably 5.5% or less, more preferably 5.2% or less, even more preferably 5.0% or less.

V: 0.01% or More and 0.5% or Less

V is an element that increases strength. By forming compounds with C and N, V also provides sufficient amounts of Cr and Mo, which contribute to corrosion resistance, and the sulfide stress cracking resistance improves as a result. V is contained in an amount of 0.01% or more to obtain this effect. The effect becomes saturated with a V content of more than 0.5%. For this reason, the V content is 0.01% or more and 0.5% or less in the disclosed embodiments. The V content is preferably 0.3% or less, more preferably 0.1% or less. The V content is preferably 0.02% or more, more preferably 0.03% or more.

Al: 0.10% or Less

Al is an element that acts as a deoxidizing agent. However, corrosion resistance decreases when Al is contained in an amount of more than 0.10%. For this reason, the Al content is 0.10% or less. The Al content is preferably 0.07% or less, more preferably 0.05% or less. It is not particularly required to set a lower limit, as long as the deoxidizing effect is obtained. However, in order to obtain a sufficient deoxidizing effect, the Al content is preferably 0.005% or more, more preferably 0.01% or more.

N: 0.10% or Less

N is an element that becomes incidentally included in the process of steelmaking. N is also an element that increases the steel strength. However, when contained in an amount of more than 0.10%, N forms nitrides, and decreases the corrosion resistance. For this reason, the N content is 0.10% or less. The N content is preferably 0.08% or less, more preferably 0.07% or less. The N content does not have a specific lower limit. However, an excessively low N content leads to increased steel making cost. For this reason, the N content is preferably 0.002% or more, more preferably 0.003% or more.

O: 0.010% or Less

O (oxygen) exists as an oxide in steel, and causes adverse effects on various properties. For this reason, O is contained preferably in as small an amount as possible in the disclosed embodiments. An O content of more than 0.010% results in decrease of hot workability and corrosion resistance. For this reason, the O content is 0.010% or less.

Ta: 0.001% or More and 0.3% or Less

Ta is an element that improves corrosion resistance. This makes Ta an important element in the disclosed embodiments. In order to obtain this effect, Ta is contained in an amount of 0.001% or more. The effect becomes saturated with a Ta content of more than 0.3%. For this reason, the Ta content is 0.001% or more and 0.3% or less in the disclosed embodiments. The Ta content is preferably 0.1% or less, more preferably 0.07% or less. The Ta content is preferably 0.005% or more, more preferably 0.007% or more.

In the disclosed embodiments, C, Si, Mn, Cr, Ni, Mo, Cu, and N are contained so as to satisfy the following formula (1), in addition to satisfying the foregoing composition.

$$13.0 \leq -5.9 \times (7.82 + 27C - 0.91Si + 0.21Mn - 0.9Cr + Ni - 1.1Mo + 0.2Cu + 11N) \leq 50.0 \quad (1)$$

In the formula, C, Si, Mn, Cr, Ni, Mo, Cu, and N represent the content of each element in mass %, and the content is 0 (zero; mass %) for elements that are not contained.

In formula (1), the expression $-5.9 \times (7.82 + 27C - 0.91Si + 0.21Mn - 0.9Cr + Ni - 1.1Mo + 0.2Cu + 11N)$ (hereinafter, referred to also as "middle polynomial of formula (1)", or, simply, "middle value") is determined as an index that indicates the likelihood of ferrite phase formation. With the alloy elements of formula (1) contained in adjusted amounts so as to satisfy formula (1), it is possible to stably produce a composite microstructure of martensitic phase and ferrite phase, or a composite microstructure of martensitic phase, ferrite phase, and retained austenite phase. When any of the alloy elements occurring in formula (1) are not contained, the value of the middle polynomial of formula (1) is calculated by regarding the content of such an element as zero percent.

When the value of the middle polynomial of formula (1) is less than 13.0, the ferrite phase decreases, and the manufacturing yield decreases.

On the other hand, when the value of the middle polynomial of formula (1) is more than 50.0, the ferrite phase becomes more than 60% by volume, and the desired strength cannot be provided.

For this reason, the formula (1) specified in the disclosed embodiments sets a left-hand value of 13.0 as the lower limit, and a right-hand value of 50.0 as the upper limit.

The lower-limit left-hand value of the formula (1) specified in the disclosed embodiments is preferably 15.0, more preferably 20.0. The right-hand value is preferably 45.0, more preferably 40.0.

In the disclosed embodiments, the balance in the composition above is Fe and incidental impurities.

In the disclosed embodiments, in addition to the foregoing basic components, the composition may further contain one or two or more optional elements (Mn, W, B, Nb, Ti, Zr, Co, Ca, REM, Mg, Sn, Sb), as follows.

Specifically, in the disclosed embodiments, the composition may additionally contain Mn: 1.0% or less.

In the disclosed embodiments, the composition may additionally contain one or two or more selected from W: 3.0% or less, B: 0.01% or less, and Nb: 0.30% or less.

In the disclosed embodiments, the composition may additionally contain one or two or more selected from Ti: 0.3% or less, Zr: 0.3% or less, and Co: 1.5% or less.

In the disclosed embodiments, the composition may additionally contain one or two or more selected from Ca: 0.01% or less, REM: 0.3% or less, Mg: 0.01% or less, Sn: 0.2% or less, and Sb: 1.0% or less.

Mn: 1.0% or Less

Mn, an optional element, is an element that acts as a deoxidizing agent and a desulfurizing agent, and improves hot workability and strength. Mn is contained in an amount of preferably 0.001% or more, more preferably 0.01% or more to obtain these effects. The effects become saturated with a Mn content of more than 1.0%. For this reason, Mn, when contained, is contained in an amount of 1.0% or less. The Mn content is preferably 0.8% or less, more preferably 0.6% or less.

W: 3.0% or Less

W, an optional element, is an element that contributes to improving steel strength, and that can increase sulfide stress cracking resistance by stabilizing the protective coating on steel pipe surface. W greatly improves the sulfide stress cracking resistance when contained with Mo. The effects become saturated with a W content of more than 3.0%. For this reason, W, when contained, is contained in an amount of 3.0% or less. The W content is preferably 0.5% or more, more preferably 0.8% or more. The W content is preferably 2.0% or less, more preferably 1.5% or less.

B: 0.01% or Less

B, an optional element, is an element that increases strength. B also contributes to improving hot workability, and has the effect to reduce fracture and cracking during the pipe making process. On the other hand, a B content of more than 0.01% produces hardly any hot workability improving effect, and results in decrease of low-temperature toughness. For this reason, B, when contained, is contained in an amount of 0.01% or less. The B content is preferably 0.008% or less, more preferably 0.007% or less. The B content is preferably 0.0005% or more, more preferably 0.001% or more.

Nb: 0.30% or Less

Nb is an element that increases strength, and may be added according to the desired strength. The effect becomes saturated with a Nb content of more than 0.30%. For this reason, Nb, when contained, is contained in an amount of 0.30% or less. The Nb content is preferably 0.25% or less, more preferably 0.2% or less. The Nb content is preferably 0.02% or more, more preferably 0.05% or more.

Ti: 0.3% or Less

Ti, an optional element, is an element that increases strength. In addition to this effect, Ti also has the effect to improve the sulfide stress cracking resistance. In order to obtain these effects, Ti is contained in an amount of preferably 0.0005% or more. A Ti content of more than 0.3% decreases toughness. For this reason, Ti, when contained, is contained in a limited amount of 0.3% or less.

Zr: 0.3% or Less

Zr, an optional element, is an element that increases strength. In addition to this effect, Zr also has the effect to improve the sulfide stress cracking resistance. In order to obtain these effects, Zr is contained in an amount of preferably 0.0005% or more. The effects become saturated with a Zr content of more than 0.3%. For this reason, Zr, when contained, is contained in a limited amount of 0.3% or less.

Co: 1.5% or Less

Co, an optional element, is an element that increases strength. In addition to this effect, Co also has the effect to improve the sulfide stress cracking resistance. In order to obtain these effects, Co is contained in an amount of preferably 0.0005% or more. The effects become saturated with a Co content of more than 1.5%. For this reason, Co, when contained, is contained in a limited amount of 1.5% or less.

Ca: 0.01% or Less

Ca, an optional element, is an element that contributes to improving the sulfide stress corrosion cracking resistance by controlling the form of sulfide. In order to obtain this effect, Ca is contained in an amount of preferably 0.0005% or more. When Ca is contained in an amount of more than 0.01%, the effect becomes saturated, and Ca cannot produce the effect expected from the increased content. For this reason, Ca, when contained, is contained in a limited amount of 0.01% or less.

REM: 0.3% or Less

REM, an optional element, is an element that contributes to improving the sulfide stress corrosion cracking resistance by controlling the form of sulfide. In order to obtain this effect, REM is contained in an amount of preferably 0.0005% or more. When REM is contained in an amount of more than 0.3%, the effect becomes saturated, and REM cannot produce the effect expected from the increased content. For this reason, REM, when contained, is contained in a limited amount of 0.3% or less.

As used herein, "REM" means scandium (Sc; atomic number 21) and yttrium (Y; atomic number 39), as well as lanthanoids from lanthanum (La; atomic number 57) to lutetium (Lu; atomic number 71). As used herein, "REM concentration" means the total content of one or two or more elements selected from the foregoing REM elements.

Mg: 0.01% or Less

Mg, an optional element, is an element that improves corrosion resistance. In order to obtain this effect, Mg is contained in an amount of preferably 0.0005% or more. When Mg is contained in an amount of more than 0.01%, the effect becomes saturated, and Mg cannot produce the effect expected from the increased content. For this reason, Mg, when contained, is contained in a limited amount of 0.01% or less.

Sn: 0.2% or Less

Sn, an optional element, is an element that improves corrosion resistance. In order to obtain this effect, Sn is contained in an amount of preferably 0.001% or more. When Sn is contained in an amount of more than 0.2%, the effect becomes saturated, and Sn cannot produce the effect expected from the increased content. For this reason, Sn, when contained, is contained in a limited amount of 0.2% or less.

Sb: 1.0% or Less

Sb, an optional element, is an element that improves corrosion resistance. In order to obtain this effect, Sb is contained in an amount of preferably 0.001% or more. When Sb is contained in an amount of more than 1.0%, the effect becomes saturated, and Sb cannot produce the effect expected from the increased content. For this reason, Sb, when contained, is contained in a limited amount of 1.0% or less.

The following describes the reason for limiting the microstructure in the seamless steel pipe of the disclosed embodiments.

In addition to having the foregoing composition, the seamless steel pipe of the disclosed embodiments has a microstructure that contains at least 30% martensitic phase, at most 60% ferrite phase, and at most 40% retained austenite phase by volume.

In order to provide the desired strength, the seamless steel pipe of the disclosed embodiments contains at least 30% martensitic phase by volume. Preferably, the martensitic phase is at least 40% by volume. In the disclosed embodiments, the ferrite is at most 60% by volume. With the ferrite phase, propagation of sulfide stress corrosion cracking and sulfide stress cracking can be reduced, and excellent corrosion resistance can be obtained. If the ferrite phase precipitates in a large amount of more than 60% by volume, it might not be possible to provide the desired strength. The ferrite phase is preferably 5% or more, more preferably 10% or more, further preferably 15% or more by volume. The ferrite phase is preferably 50% or less by volume.

The seamless steel pipe of the disclosed embodiments contains at most 40% austenitic phase (retained austenite phase) by volume, in addition to the martensitic phase and the ferrite phase. Ductility and toughness improve by the presence of the retained austenite phase. If the austenitic phase precipitates in a large amount of more than 40% by volume, it is not possible to provide the desired strength because of the martensite failing to satisfy the desired amount as a result of the increased amount of retained austenite. For this reason, the retained austenite phase is 40% or less by volume. The retained austenite phase is preferably 5% or more by volume. The retained austenite phase is preferably 30% or less, more preferably 25% or less by volume.

For the measurement of the microstructure of the seamless steel pipe of the disclosed embodiments, a test specimen for microstructure observation is corroded with a Vilella's solution (a mixed reagent containing at a rate of 2 g of picric acid, 10 ml of hydrochloric acid, and 100 ml of ethanol), and the structure is imaged with a scanning electron microscope (1,000 times magnification). The fraction of the ferrite phase microstructure (area ratio (%)) is then calculated with an image analyzer. The area ratio is defined as the volume ratio (%) of the ferrite phase.

Separately, an X-ray diffraction test specimen is ground and polished to have a measurement cross section (C cross section) orthogonal to the axial direction of pipe, and the fraction of the retained austenite (γ) phase microstructure is measured by an X-ray diffraction method. The fraction of the retained austenite phase microstructure is determined by measuring X-ray diffraction integral intensity for the (220) plane of the austenite phase (γ), and the (211) plane of the ferrite phase (α), and converting the calculated values using the following formula.

$$\gamma \text{ (volume ratio)} = 100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ.

The fraction of the martensitic phase is the remainder other than the fractions of the ferrite phase and retained γ phase determined by the foregoing measurement method. As used herein, "martensitic phase" may contain at most 5% precipitate phase by volume, other than the martensitic phase, the ferrite phase, and the retained austenite phase.

The following describes a preferred method for manufacturing a stainless steel seamless pipe of the disclosed embodiments.

Preferably, a molten steel of the foregoing composition is made using a steelmaking process such as by using a converter, and formed into a steel pipe material, for example, a billet, using an ordinary method such as continuous casting, or ingot casting-billeting. The steel pipe material is then hot worked into a pipe using a known pipe manufacturing process, for example, the Mannesmann-plug mill process or the Mannesmann-mandrel mill process, to produce a seamless steel pipe of desired dimensions having the foregoing composition. The hot working may be followed by cooling. The cooling process is not particularly limited. After the hot working, the pipe is cooled to room temperature at a cooling rate about the same as air cooling, provided that the composition falls in the range of the disclosed embodiments.

In the disclosed embodiments, this is followed by a heat treatment that includes quenching and tempering.

In quenching, the steel pipe is reheated to a temperature of 850 to 1,150° C., and cooled at a cooling rate of air cooling or faster. The cooling stop temperature is 50° C. or less in terms of a surface temperature. When the heating temperature is less than 850° C., a reverse transformation from martensite to austenite does not occur, and the austenite does not transform into martensite during cooling, with the result that the desired strength cannot be provided. On the other hand, the crystal grains coarsen when the heating temperature exceeds 1,150° C. For this reason, the heating temperature of quenching is 850 to 1,150° C. The heating temperature of quenching is preferably 900° C. or more. The heating temperature of quenching is preferably 1,100° C. or less.

When the cooling stop temperature is more than 50° C., the austenite does not sufficiently transform into martensite, and the fraction of retained austenite becomes overly high. For this reason, the cooling stop temperature of the cooling in quenching is 50° C. or less in the disclosed embodiments.

Here, "cooling rate of air cooling or faster" means 0.01° C./s or more.

In quenching, the soaking retention time is preferably 5 to 30 minutes, in order to achieve a uniform temperature along a wall thickness direction, and prevent variation in the material.

In tempering, the quenched seamless steel pipe is heated to a heating temperature (tempering temperature) of 500 to 650° C. The heating may be followed by natural cooling. A tempering temperature of less than 500° C. is too low to produce the desired tempering effect as intended. When the tempering temperature is higher than 650° C., precipitation of intermetallic compounds occurs, and it is not possible to obtain desirable low-temperature toughness. For this reason, the tempering temperature is 500 to 650° C. The tempering temperature is preferably 520° C. or more. The tempering temperature is preferably 630° C. or less.

In tempering, the soaking retention time is preferably 5 to 90 minutes, in order to achieve a uniform temperature along a wall thickness direction, and prevent variation in the material.

After the heat treatment (quenching and tempering), the seamless steel pipe has a microstructure in which the martensitic phase, the ferrite phase, and the retained austenite phase are contained in a specific predetermined volume ratio. In this way, the stainless steel seamless pipe can have the desired strength and excellent corrosion resistance.

The stainless steel seamless pipe obtained in the disclosed embodiments in the manner described above is a high-strength steel pipe having a yield strength of 758 MPa or more, and has excellent corrosion resistance. Preferably, the yield strength is 862 MPa or more. Preferably, the yield strength is 1,034 MPa or less. The stainless steel seamless pipe of the disclosed embodiments can be used as a stainless steel seamless pipe for oil country tubular goods (a high-strength stainless steel seamless pipe for oil country tubular goods).

EXAMPLES

The disclosed embodiments further described below through Examples.

Molten steels of the compositions shown in Table 1-1 and Table 1-2 (Steel Nos. A to BE) were cast into steel pipe materials. The steel pipe material was heated, and hot worked into a seamless steel pipe measuring 83.8 mm in outer diameter and 12.7 mm in wall thickness, using a model seamless rolling mill. The seamless steel pipe was then cooled by air cooling. The heating of the steel pipe material before hot working was carried out at a heating temperature of 1,250° C.

Each seamless steel pipe was cut into a test specimen material, which was then subjected to quenching that included reheating to a temperature of 960° C., and cooling (water cooling) the test specimen to a cooling stop temperature of 30° C. with 20 minutes of retention in soaking. This was followed by tempering that included heating to a temperature of 575° C. or 620° C., and air cooling the test specimen with 20 minutes of retention in soaking. This produced steel pipe Nos. 1 to 60. In quenching, the water cooling was carried out at a cooling rate of 11° C./s. The air cooling (natural cooling) in tempering was carried out at a cooling rate of 0.04° C./s. The heating temperature of tempering is 575° C. for steel pipe Nos. 1 to 57, and 620° C. for steel pipe Nos. 58 to 60.

TABLE 1-1

| Steel | Composition (mass %) | | | | | | | | | | | | | | |
|---|---|---|---|---|---|---|---|---|---|---|---|---|---|---|---|
| No. | C | Si | Mn | P | S | Cr | Mo | Cu | Ni | V | Al | N | 0 | Ta | Other |
| A | 0.013 | 0.29 | 0.286 | 0.017 | 0.0010 | 16.23 | 2.44 | 2.41 | 3.50 | 0.058 | 0.030 | 0.023 | 0.0021 | 0.0415 | — |
| B | 0.008 | 0.29 | 0.304 | 0.015 | 0.0009 | 16.22 | 2.50 | 2.67 | 4.26 | 0.062 | 0.026 | 0.037 | 0.0021 | 0.0515 | — |
| C | 0.014 | 0.35 | 0.291 | 0.014 | 0.0011 | 16.27 | 2.40 | 2.47 | 4.46 | 0.029 | 0.027 | 0.027 | 0.0022 | 0.0145 | — |
| D | 0.057 | 0.33 | 0.325 | 0.016 | 0.0012 | 16.37 | 2.43 | 2.53 | 3.80 | 0.050 | 0.023 | 0.023 | 0.0020 | 0.0210 | — |

TABLE 1-1-continued

| | | | | | | | | | | | | | | | |
|---|---|---|---|---|---|---|---|---|---|---|---|---|---|---|---|
| E | 0.013 | 0.92 | 0.304 | 0.015 | 0.0011 | 17.21 | 2.57 | 2.46 | 4.02 | 0.057 | 0.024 | 0.021 | 0.0020 | 0.0020 | — |
| F | 0.009 | 0.33 | 0.900 | 0.016 | 0.0012 | 16.93 | 2.63 | 2.43 | 3.88 | 0.027 | 0.027 | 0.024 | 0.0020 | 0.0055 | — |
| G | 0.008 | 0.34 | 0.030 | 0.016 | 0.0009 | 16.73 | 2.66 | 2.61 | 4.25 | 0.084 | 0.027 | 0.023 | 0.0021 | 0.0525 | — |
| H | 0.011 | 0.35 | 0.297 | 0.043 | 0.0009 | 17.19 | 2.55 | 2.50 | 4.69 | 0.050 | 0.030 | 0.031 | 0.0021 | 0.0430 | — |
| 1 | 0.012 | 0.32 | 0.308 | 0.015 | 0.0042 | 17.02 | 2.64 | 2.63 | 3.82 | 0.041 | 0.024 | 0.039 | 0.0021 | 0.0120 | — |
| J | 0.010 | 0.33 | 0.311 | 0.017 | 0.0011 | 17.38 | 2.65 | 2.51 | 4.85 | 0.057 | 0.025 | 0.039 | 0.0021 | 0.0365 | — |
| K | 0.014 | 0.32 | 0.310 | 0.015 | 0.0011 | 15.85 | 2.65 | 2.64 | 4.25 | 0.053 | 0.023 | 0.026 | 0.0021 | 0.0210 | — |
| L | 0.010 | 0.30 | 0.338 | 0.014 | 0.0009 | 17.27 | 3.40 | 2.61 | 4.17 | 0.040 | 0.026 | 0.024 | 0.0021 | 0.0060 | — |
| M | 0.014 | 0.32 | 0.302 | 0.014 | 0.0010 | 17.15 | 2.00 | 2.66 | 3.89 | 0.055 | 0.023 | 0.021 | 0.0022 | 0.0210 | — |
| N | 0.011 | 0.33 | 0.324 | 0.015 | 0.0009 | 17.22 | 2.43 | 3.39 | 4.46 | 0.052 | 0.029 | 0.036 | 0.0021 | 0.0475 | — |
| O | 0.013 | 0.31 | 0.322 | 0.014 | 0.0010 | 16.42 | 2.45 | 1.76 | 4.40 | 0.033 | 0.026 | 0.024 | 0.0020 | 0.0550 | — |
| P | 0.009 | 0.30 | 0.335 | 0.015 | 0.0011 | 17.09 | 2.70 | 2.56 | 5.31 | 0.067 | 0.028 | 0.027 | 0.0019 | 0.0090 | — |
| Q | 0.010 | 0.32 | 0.348 | 0.016 | 0.0012 | 16.51 | 2.46 | 2.61 | 3.31 | 0.063 | 0.024 | 0.024 | 0.0019 | 0.0175 | — |
| R | 0.010 | 0.34 | 0.308 | 0.016 | 0.0009 | 16.83 | 2.63 | 2.58 | 4.70 | 0.404 | 0.030 | 0.034 | 0.0021 | 0.0270 | — |
| S | 0.011 | 0.29 | 0.282 | 0.016 | 0.0010 | 16.73 | 2.63 | 2.66 | 4.43 | 0.036 | 0.028 | 0.032 | 0.0020 | 0.0340 | — |
| T | 0.008 | 0.35 | 0.335 | 0.016 | 0.0009 | 16.23 | 2.45 | 2.64 | 4.56 | 0.055 | 0.083 | 0.037 | 0.0021 | 0.0410 | — |
| U | 0.010 | 0.31 | 0.287 | 0.015 | 0.0010 | 17.39 | 2.46 | 2.65 | 4.60 | 0.049 | 0.026 | 0.080 | 0.0022 | 0.0130 | — |
| V | 0.012 | 0.35 | 0.299 | 0.016 | 0.0012 | 16.58 | 2.45 | 2.69 | 4.07 | 0.030 | 0.030 | 0.037 | 0.0087 | 0.0455 | — |
| W | 0.008 | 0.31 | 0.312 | 0.014 | 0.0010 | 16.55 | 2.66 | 2.41 | 4.46 | 0.039 | 0.026 | 0.035 | 0.0020 | 0.2690 | — |
| X | 0.015 | 0.30 | 0.285 | 0.017 | 0.0011 | 16.57 | 2.66 | 2.63 | 4.67 | 0.063 | 0.023 | 0.028 | 0.0020 | 0.0019 | — |
| Y | 0.005 | 0.91 | 0.040 | 0.016 | 0.0011 | 16.24 | 3.48 | 1.56 | 3.12 | 0.038 | 0.028 | 0.011 | 0.0022 | 0.0015 | — |
| Z | 0.032 | 0.02 | 0.510 | 0.014 | 0.0010 | 16.02 | 2.25 | 2.58 | 5.00 | 0.055 | 0.029 | 0.030 | 0.0021 | 0.0125 | — |

| | Formula (1) (*3) | | |
|---|---|---|---|
| Steel No. | Middle value | Result | Remarks (*4) |
| A | 30.2 | Satisfactory | PS |
| B | 25.4 | Satisfactory | PS |
| C | 24.1 | Satisfactory | PS |
| D | 22.0 | Satisfactory | PS |
| E | 36.5 | Satisfactory | PS |
| F | 32.7 | Satisfactory | PS |
| G | 30.8 | Satisfactory | PS |
| H | 28.8 | Satisfactory | PS |
| 1 | 32.7 | Satisfactory | PS |
| J | 29.1 | Satisfactory | PS |
| K | 24.4 | Satisfactory | PS |
| L | 38.0 | Satisfactory | PS |
| M | 29.5 | Satisfactory | PS |
| N | 28.0 | Satisfactory | PS |
| O | 26.6 | Satisfactory | PS |
| P | 25.8 | Satisfactory | PS |
| Q | 32.9 | Satisfactory | PS |
| R | 27.2 | Satisfactory | PS |
| S | 27.9 | Satisfactory | PS |
| T | 23.6 | Satisfactory | PS |
| U | 26.5 | Satisfactory | PS |
| V | 27.8 | Satisfactory | PS |
| W | 27.5 | Satisfactory | PS |
| X | 25.5 | Satisfactory | PS |
| Y | 45.8 | Satisfactory | PS |
| Z | 13.5 | Satisfactory | PS |

(*1) The balance is Fe and incidental impurities (*2) Underline means outside of the range of the disclosed embodiments (*3) Formula (1): $13.0 \leq -5.9 \times (7.82 + 27C - 0.91Si + 0.21Mn - 0.9Cr + Ni - 1.1Mo + 0.2Cu + 11N) \leq 50.0$ (*4) PS: Present Steel, CS: Comparative Steel

TABLE 2

| Steel | Composition (mass %) | | | | | | | | | | | | | |
|---|---|---|---|---|---|---|---|---|---|---|---|---|---|---|
| No. | C | Si | Mn | P | S | Cr | Mo | Cu | Ni | V | Al | N | O | Ta |
| AA | 0.012 | 0.29 | 0.343 | 0.014 | 0.0011 | 16.52 | 2.51 | 2.57 | 4.47 | 0.082 | 0.029 | 0.040 | 0.0019 | 0.0540 |
| AB | 0.012 | 0.33 | 0.311 | 0.015 | 0.0009 | 16.20 | 2.41 | 2.56 | 4.80 | 0.037 | 0.023 | 0.025 | 0.0020 | 0.0525 |
| AC | 0.008 | 0.35 | 0.347 | 0.017 | 0.0010 | 16.78 | 2.45 | 2.56 | 4.53 | 0.072 | 0.027 | 0.034 | 0.0019 | 0.0240 |
| AD | 0.008 | 0.32 | 0.297 | 0.017 | 0.0011 | 16.53 | 2.66 | 2.58 | 3.96 | 0.056 | 0.028 | 0.032 | 0.0021 | 0.0090 |
| AE | 0.014 | 0.35 | 0.346 | 0.015 | 0.0010 | 16.23 | 2.64 | 2.54 | 4.80 | 0.068 | 0.028 | 0.034 | 0.0021 | 0.0470 |
| AF | 0.014 | 0.32 | 0.289 | 0.014 | 0.0011 | 17.34 | 2.57 | 2.68 | 4.59 | 0.049 | 0.027 | 0.032 | 0.0021 | 0.0255 |
| AG | 0.009 | 0.31 | 0.330 | 0.014 | 0.0009 | 16.66 | 2.41 | 2.50 | 4.15 | 0.085 | 0.027 | 0.023 | 0.0020 | 0.0075 |
| AH | 0.011 | 0.29 | 0.287 | 0.017 | 0.0010 | 16.23 | 2.44 | 2.51 | 3.79 | 0.014 | 0.019 | 0.021 | 0.0022 | 0.0319 |
| Al | 0.013 | 0.29 | 0.286 | 0.016 | 0.0010 | 16.38 | 2.41 | 2.41 | 3.91 | 0.036 | 0.023 | 0.019 | 0.0023 | 0.0415 |
| AJ | 0.012 | 0.29 | 0.299 | 0.017 | 0.0010 | 16.44 | 2.49 | 2.58 | 3.50 | 0.040 | 0.024 | 0.023 | 0.0019 | 0.0198 |
| AK | 0.014 | 0.33 | 0.315 | 0.016 | 0.0010 | 16.75 | 2.49 | 2.58 | 4.91 | 0.048 | 0.020 | 0.013 | 0.0019 | 0.0135 |
| AL | 0.066 | 0.00 | 0.291 | 0.015 | 0.0009 | 17.06 | 2.45 | 2.59 | 3.69 | 0.025 | 0.024 | 0.037 | 0.0021 | 0.0220 |

TABLE 2-continued

| | | | | | | | | | | | | | | |
|---|---|---|---|---|---|---|---|---|---|---|---|---|---|---|
| AM | 0.013 | 1.11 | 0.288 | 0.017 | 0.0010 | 16.90 | 2.60 | 2.66 | 4.23 | 0.050 | 0.026 | 0.023 | 0.0019 | 0.0105 |
| AN | 0.009 | 0.34 | 0.003 | 0.016 | 0.0010 | 17.38 | 2.65 | 2.58 | 4.17 | 0.028 | 0.027 | 0.026 | 0.0020 | 0.0425 |
| AO | 0.013 | 0.34 | 0.291 | 0.055 | 0.0009 | 16.53 | 2.51 | 2.67 | 3.84 | 0.051 | 0.028 | 0.034 | 0.0020 | 0.0315 |
| AP | 0.013 | 0.29 | 0.348 | 0.015 | 0.0055 | 16.59 | 2.50 | 2.64 | 4.67 | 0.038 | 0.026 | 0.024 | 0.0020 | 0.0330 |
| AQ | 0.012 | 0.34 | 0.350 | 0.016 | 0.0010 | 17.65 | 2.56 | 2.67 | 4.67 | 0.083 | 0.023 | 0.020 | 0.0021 | 0.0170 |
| AR | 0.014 | 0.29 | 0.335 | 0.015 | 0.0009 | 15.58 | 2.44 | 2.65 | 3.75 | 0.063 | 0.026 | 0.030 | 0.0021 | 0.0425 |
| AS | 0.012 | 0.31 | 0.285 | 0.015 | 0.0012 | 17.13 | 1.50 | 2.50 | 4.10 | 0.041 | 0.025 | 0.025 | 0.0020 | 0.0500 |
| AT | 0.012 | 0.32 | 0.311 | 0.015 | 0.0009 | 16.47 | 2.41 | 1.43 | 4.08 | 0.073 | 0.028 | 0.033 | 0.0021 | 0.0285 |
| AU | 0.009 | 0.31 | 0.294 | 0.015 | 0.0012 | 16.67 | 2.65 | 2.50 | 5.72 | 0.039 | 0.030 | 0.027 | 0.0022 | 0.0500 |
| AV | 0.010 | 0.32 | 0.287 | 0.017 | 0.0009 | 16.82 | 2.57 | 2.64 | 2.76 | 0.080 | 0.027 | 0.020 | 0.0021 | 0.0545 |
| AW | 0.010 | 0.31 | 0.338 | 0.015 | 0.0011 | 16.67 | 2.49 | 2.70 | 4.63 | 0.004 | 0.026 | 0.028 | 0.0019 | 0.0050 |
| AX | 0.010 | 0.35 | 0.331 | 0.016 | 0.0010 | 16.20 | 2.59 | 2.66 | 3.74 | 0.068 | 0.120 | 0.022 | 0.0019 | 0.0080 |
| AY | 0.015 | 0.28 | 0.311 | 0.016 | 0.0010 | 17.10 | 2.48 | 2.64 | 4.35 | 0.070 | 0.023 | 0.123 | 0.0019 | 0.0175 |
| AZ | 0.015 | 0.28 | 0.276 | 0.016 | 0.0010 | 17.47 | 2.68 | 2.64 | 4.76 | 0.046 | 0.027 | 0.023 | 0.0115 | 0.0425 |
| BA | 0.010 | 0.28 | 0.341 | 0.014 | 0.0011 | 16.84 | 2.44 | 2.57 | 4.50 | 0.047 | 0.026 | 0.028 | 0.0021 | 0.0004 |
| BB | 0.007 | 0.93 | 0.020 | 0.016 | 0.0011 | 17.33 | 3.36 | 1.61 | 3.01 | 0.028 | 0.030 | 0.012 | 0.0022 | 0.0090 |
| BC | 0.015 | 0.30 | 0.301 | 0.016 | 0.0010 | 18.19 | 2.51 | 2.64 | 4.72 | 0.043 | 0.023 | 0.018 | 0.0021 | 0.0153 |
| BD | 0.013 | 0.29 | 0.286 | 0.017 | 0.0010 | 16.23 | 2.44 | 2.41 | 6.12 | 0.058 | 0.030 | 0.023 | 0.0021 | 0.0415 |
| BE | 0.014 | 0.35 | 0.291 | 0.014 | 0.0011 | 16.27 | 2.40 | 2.47 | 2.43 | 0.029 | 0.027 | 0.027 | 0.0022 | 0.0145 |

| Composition (mass %) | Formula (1) (*3) | | |
|---|---|---|---|
| Other | Middle value | Result | Remarks (*4) |
| Nb:0.093 | 25.1 | Satisfactory | PS |
| W: 1.54 | 22.1 | Satisfactory | PS |
| W: 2.67, Nb: 0.073, B: 0.007 | 27.0 | Satisfactory | PS |
| W: 0.45, Nb: 0.055, Ti: 0.18, Zr: 0.22, Co: 1.1 | 30.5 | Satisfactory | PS |
| W: 0.53, Ca: 0.0059, Mg: 0.0047, Sn: 0.148 | 23.0 | Satisfactory | PS |
| Nb: 0.039, Ti :0.09, REM: 0.098 | 29.4 | Satisfactory | PS |
| W: 1.20, Nb: 0.080, Zr: 0.13, Sb: 0.89 | 28.9 | Satisfactory | PS |
| Ti: 0.17, Zr: 0.16 | 28.7 | Satisfactory | PS |
| Ca: 0.0028, REM: 0.132, Sn: 0.100 | 28.6 | Satisfactory | PS |
| Ti: 0.22, Zr: 0.19, REM: 0.118 | 31.4 | Satisfactory | PS |
| Co: 0.3 | 25.3 | Satisfactory | PS |
| — | 22.2 | Satisfactory | CS |
| — | 34.5 | Satisfactory | CS |
| — | 34.4 | Satisfactory | PS |
| — | 29.4 | Satisfactory | CS |
| — | 25.0 | Satisfactory | CS |
| — | 31.6 | Satisfactory | PS |
| — | 24.2 | Satisfactory | CS |
| — | 25.2 | Satisfactory | CS |
| — | 28.4 | Satisfactory | CS |
| — | 21.0 | Satisfactory | PS |
| — | 39.0 | Satisfactory | PS |
| — | 25.7 | Satisfactory | CS |
| — | 29.9 | Satisfactory | CS |
| — | 22.8 | Satisfactory | CS |
| — | 30.1 | Satisfactory | CS |
| — | 27.2 | Satisfactory | CS |
| — | 51.1 | Unsatisfactory | CS |
| — | 33.5 | Satisfactory | CS |
| — | 14.7 | Satisfactory | CS |
| — | 36.1 | Satisfactory | CS |

(*1) The balance is Fe and incidental impurities (*2) Underline means outside of the range of the disclosed embodiments (*3) Formula (1): $13.0 \leq -5.9 \times (7.82 + 27C - 0.91Si + 0.21Mn - 0.9Cr + Ni - 1.1Mo + 0.2Cu + 11N) \leq 50.0$ (*4) PS: Present Steel, CS: Comparative Steel A test specimen was taken from the heat-treated test material (seamless steel pipe), and subjected to microstructure observation, a tensile test, and a corrosion resistance test. The test methods are as follows.

(1) Microstructure Observation

A test specimen for microstructure observation was taken from the heat-treated test material in such an orientation that a cross section orthogonal to the pipe axis direction was exposed for observation. The test specimen for microstructure observation was corroded with a Vilella's solution (a mixed reagent containing at a rate of 2 g of picric acid, 10 ml of hydrochloric acid, and 100 ml of ethanol), and the structure was imaged with a scanning electron microscope (1,000 times magnification). The fraction (area ratio (%)) of the ferrite phase microstructure was then calculated with an image analyzer. Here, the area ratio was calculated as the volume ratio (%) of the ferrite phase.

Separately, an X-ray diffraction test specimen was taken from the heat-treated test material. The test specimen was ground and polished to have a measurement cross section (C cross section) orthogonal to the axial direction of pipe, and the fraction of the retained austenite (γ) phase microstructure was measured by an X-ray diffraction method. The fraction of the retained austenite phase microstructure was determined by measuring X-ray diffraction integral intensity for the (220) plane of the austenite phase (γ), and the (211) plane of the ferrite phase (α), and converting the calculated values using the following formula.

$$\gamma \text{ (volume ratio)} = 100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ. The fraction of the martensitic phase is the remainder other than the fractions of the ferrite phase and retained γ phase.

(2) Tensile Test

An API (American Petroleum Institute) arc-shaped tensile test specimen was taken from the heat-treated test material in such an orientation that the test specimen had a tensile direction along the pipe axis direction. The tensile test was conducted according to the API specifications to determine tensile properties (yield strength YS). The steel was determined as being high strength and acceptable when it had a yield strength YS of 758 MPa or more, and unacceptable when it had a yield strength YS of less than 758 MPa.

(3) Corrosion Resistance Test

A corrosion test specimen measuring 3 mm in thickness, 30 mm in width, and 40 mm in length was prepared from the heat-treated test material by machining, and subjected to a corrosion test to evaluate carbon dioxide gas corrosion resistance.

The corrosion test was conducted by immersing the corrosion test specimen in a test solution: a 20 mass % NaCl aqueous solution (liquid temperature: 200° C.; an atmosphere of 30-atm $CO_2$ gas) in an autoclave for 14 days (336 hours). The corrosion rate was determined from the calculated reduction in the weight of the tested specimen measured before and after the corrosion test. The steel was determined as being acceptable when it had a corrosion rate of 0.127 mm/y or less, and unacceptable when it had a corrosion rate of more than 0.127 mm/y.

A round rod-shaped test specimen (diameter: 3.81 mm) was prepared from the test specimen material by machining, and was subjected to a sulfide stress cracking resistance test (SSC resistance test).

The SSC resistance test was determined by conducting an RLT test, in which a test specimen was immersed in a test solution (a 20 mass % NaCl aqueous solution; liquid temperature: 25° C.; an atmosphere of 0.9 atm $CO_2$ gas and 0.1 atm $H_2S$) kept in an autoclave and having an adjusted pH of 3.5 with addition of acetic acid and sodium acetate, and the stress was repeatedly increased and decreased at a strain rate of $1\times10^{-6}$/s and a strain rate of $5\times10^{-6}$/s, respectively, for 1 week between 100% yield stress and 80% yield stress. After the test, the test specimen was observed for the presence or absence of cracking. The steel was determined as being acceptable when it did not have a crack, and unacceptable when it had a crack.

The results are presented in Table 2.

TABLE 2

| Steel No. | Steel pipe No. | Microstructure (volume %) M (*1) | F (*1) | A (*1) | Yield strength YS (MPa) | Corrosion rate (mm/y) | SSC | Remarks |
|---|---|---|---|---|---|---|---|---|
| A | 1 | 64 | 33 | 3 | 995 | 0.035 | Acceptable | Present Example |
| B | 2 | 56 | 27 | 17 | 949 | 0.032 | Acceptable | Present Example |
| C | 3 | 67 | 25 | 18 | 958 | 0.029 | Acceptable | Present Example |
| D | 4 | bb | 22 | 23 | 947 | 0.103 | Acceptable | Present Example |
| E | 5 | 44 | 42 | 14 | 883 | 0.110 | Acceptable | Present Example |
| F | 6 | b1 | 37 | 12 | 922 | 0.044 | Acceptable | Present Example |
| G | 7 | 47 | 34 | 19 | 903 | 0.027 | Acceptable | Present Example |
| H | 8 | 49 | 31 | 20 | 914 | 0.078 | Acceptable | Present Example |
| I | 9 | 48 | 37 | 15 | 908 | 0.083 | Acceptable | Present Example |
| J | 10 | 41 | 32 | 27 | 868 | 0.022 | Acceptable | Present Example |
| K | 11 | 68 | 25 | 7 | 1018 | 0.111 | Acceptable | Present Example |
| L | 12 | 41 | 40 | 19 | 868 | 0.019 | Acceptable | Present Example |
| M | 13 | 55 | 32 | 13 | 945 | 0.098 | Acceptable | Present Example |
| N | 14 | 48 | 30 | 22 | 907 | 0.025 | Acceptable | Present Example |
| O | 1b | 57 | 28 | 15 | 957 | 0.095 | Acceptable | Present Example |
| P | 16 | 4/ | 27 | 26 | 901 | 0.030 | Acceptable | Present Example |
| Q | 17 | 59 | 37 | 4 | 968 | 0.058 | Acceptable | Present Example |
| R | 18 | 52 | 29 | 19 | 929 | 0.025 | Acceptable | Present Example |
| S | 19 | 46 | 30 | 24 | 896 | 0.058 | Acceptable | Present Example |
| T | 20 | 64 | 24 | 12 | 995 | 0.032 | Acceptable | Present Example |
| U | 21 | 4/ | 28 | 25 | 901 | 0.033 | Acceptable | Present Example |
| V | 22 | 50 | 30 | 20 | 918 | 0.058 | Acceptable | Present Example |
| W | 23 | 55 | 30 | 15 | 945 | 0.028 | Acceptable | Present Example |
| X | 24 | 58 | 27 | 15 | 962 | 0.040 | Acceptable | Present Example |
| Y | 2b | 41 | 50 | 9 | 868 | 0.032 | Acceptable | Present Example |
| Z | 26 | 67 | 11 | 22 | 1012 | 0.048 | Acceptable | Present Example |
| AA | 27 | 53 | 26 | 21 | 934 | 0.018 | Acceptable | Present Example |
| AB | 28 | 59 | 22 | 19 | 968 | 0.021 | Acceptable | Present Example |
| AC | 29 | 54 | 29 | 17 | 940 | 0.017 | Acceptable | Present Example |
| AD | 30 | 49 | 34 | 17 | 912 | 0.033 | Acceptable | Present Example |
| AE | 31 | 56 | 23 | 21 | 951 | 0.037 | Acceptable | Present Example |
| AF | 32 | 46 | 32 | 22 | 896 | 0.030 | Acceptable | Present Example |
| AG | 33 | 59 | 31 | 10 | 968 | 0.028 | Acceptable | Present Example |
| AH | 34 | 52 | 31 | 17 | 929 | 0.030 | Acceptable | Present Example |
| AI | 35 | 54 | 33 | 13 | 940 | 0.026 | Acceptable | Present Example |
| AJ | 36 | 58 | 28 | 14 | 962 | 0.031 | Acceptable | Present Example |
| AK | 37 | 55 | 30 | 15 | 945 | 0.022 | Acceptable | Present Example |
| AL | 38 | 39 | 28 | 33 | 843 | 0.159 | Unacceptable | Comparative Example |
| AM | 39 | 37 | 39 | 24 | 846 | 0.138 | Unacceptable | Comparative Example |
| AN | 40 | 43 | 39 | 18 | 853 | 0.025 | Acceptable | Present Example |
| AO | 41 | 55 | 32 | 13 | 945 | 0.135 | Unacceptable | Comparative Example |
| AP | 42 | 58 | 26 | 16 | 962 | 0.140 | Unacceptable | Comparative Example |
| AQ | 43 | 37 | 35 | 28 | 846 | 0.016 | Acceptable | Present Example |

TABLE 2-continued

| Steel No. | Steel pipe No. | Microstructure (volume %) M (*1) | F (*1) | A (*1) | Yield strength YS (MPa) | Corrosion rate (mm/y) | SSC | Remarks |
|---|---|---|---|---|---|---|---|---|
| AR | 44 | 71 | 25 | 4 | 1034 | 0.158 | Unacceptable | Comparative Example |
| AS | 4b | 60 | 27 | 13 | 973 | 0.130 | Unacceptable | Comparative Example |
| AT | 46 | 59 | 31 | 10 | 843 | 0.134 | Unacceptable | Comparative Example |
| AU | 47 | 39 | 23 | 38 | 857 | 0.028 | Acceptable | Present Example |
| AV | 48 | 47 | 45 | 8 | 841 | 0.079 | Acceptable | Present Example |
| AW | 49 | 48 | 27 | 25 | 839 | 0.073 | Unacceptable | Comparative Example |
| AX | 50 | 55 | 33 | 12 | 945 | 0.036 | Unacceptable | Comparative Example |
| AY | 51 | 40 | 23 | 37 | 863 | 0.034 | Unacceptable | Comparative Example |
| AZ | 52 | 41 | 33 | 26 | 868 | 0.081 | Unacceptable | Comparative Example |
| BA | 53 | 52 | 29 | 19 | 929 | 0.053 | Unacceptable | Comparative Example |
| BB | 54 | 23 | 61 | 16 | 743 | 0.027 | Acceptable | Comparative Example |
| BC | 55 | 26 | 43 | 31 | 733 | 0.019 | Acceptable | Comparative Example |
| BD | 56 | 29 | 27 | 44 | 738 | 0.029 | Acceptable | Comparative Example |
| BE | 57 | 36 | 49 | 15 | 725 | 0.09b | Acceptable | Comparative Example |
| A | 58 | 37 | 32 | 31 | 846 | 0.03b | Acceptable | Present Example |
| B | 59 | 39 | 28 | 33 | 857 | 0.032 | Acceptable | Present Example |
| C | 60 | 37 | 29 | 34 | 846 | 0.029 | Acceptable | Present Example |

Underline means outside of the range of the disclosed embodiments (*1) M: Martensitic phase, F: Ferrite phase, A: Retained austenite phase The stainless steel seamless pipes of the present examples all had high strength with a yield strength YS of 758 MPa or more. The stainless steel seamless pipes of the present examples also had excellent corrosion resistance (carbon dioxide gas corrosion resistance) in a $CO_2$- and $Cl^-$-containing high-temperature corrosive environment of 200° C., and excellent sulfide stress cracking resistance as demonstrated by the absence of cracking (SSC) in a $H_2S$-containing environment.

The invention claimed is:

1. A stainless steel seamless pipe having a composition that comprises, by mass %:

C: 0.06% or less;
Si: 1.0% or less;
P: 0.05% or less;
S: 0.005% or less;
Cr: more than 15.8% and 18.0% or less;
Mo: 1.8% or more and 3.5% or less;
Cu: more than 1.5% and 3.5% or less;
Ni: 2.5% or more and 6.0% or less;
V: 0.01% or more and 0.5% or less;
Al: 0.10% or less;
N: 0.10% or less;
O: 0.010% or less;
Ta: 0.001% or more and 0.3% or less; and
the balance being Fe and incidental impurities,
wherein:
C, Si, Mn, Cr, Ni, Mo, Cu, and N satisfy formula (1):

$$13.0 \leq -5.9 \times (7.82 + 27C - 0.91Si + 0.21Mn - 0.9Cr + Ni - 1.1Mo + 0.2Cu + 11N) \leq 50.0 \quad (1),$$

where C, Si, Mn, Cr, Ni, Mo, Cu, and N in the formula (1) represent the content, by mass %, of each element in the composition, and the content of any elements that are not contained in the composition is 0 mass %, the stainless steel seamless pipe has a microstructure containing at least 30% martensitic phase, at most 60% ferrite phase, and at most 40% retained austenite phase by volume, the stainless steel seamless pipe has a yield strength of 758 MPa or more, and the composition does not contain W.

2. The stainless steel seamless pipe according to claim 1, wherein the composition further comprises, by mass %, Mn: 1.0% or less.

3. The stainless steel seamless pipe according to claim 1, wherein: the stainless steel seamless pipe has a microstructure containing at least 40% martensitic phase, at most 60% ferrite phase, and at most 30% retained austenite phase by volume, and has a yield strength of 862 MPa or more.

4. The stainless steel seamless pipe according to claim 2, wherein: the stainless steel seamless pipe has a microstructure containing at least 40% martensitic phase, at most 60% ferrite phase, and at most 30% retained austenite phase by volume, and has a yield strength of 862 MPa or more.

5. The stainless steel seamless pipe according to claim 1, wherein the composition further comprises, by mass %, one or more Groups selected from the following Groups A to C:

Group A: one or more selected from:
B: 0.01% or less, and
Nb: 0.30% or less,
Group B: one or more selected from:
Ti: 0.3% or less,
Zr: 0.3% or less, and
Co: 1.5% or less, and
Group C: one or more selected from:
Ca: 0.01% or less,
REM: 0.3% or less,
Mg: 0.01% or less,
Sn: 0.2% or less, and
Sb: 1.0% or less.

6. The stainless steel seamless pipe according to claim 2, wherein the composition further comprises, by mass %, one or more Groups selected from the following Groups A to C:

Group A: one or more selected from:
B: 0.01% or less, and
Nb: 0.30% or less,
Group B: one or more selected from:
Ti: 0.3% or less,
Zr: 0.3% or less, and
Co: 1.5% or less, and
Group C: one or more selected from:
Ca: 0.01% or less,
REM: 0.3% or less,
Mg: 0.01% or less, Sn: 0.2% or less, and
Sb: 1.0% or less.

7. The stainless steel seamless pipe according claim 3, wherein the composition further comprises, by mass %, one or more Groups selected from the following Groups A to C:

Group A: one or more selected from:
B: 0.01% or less, and
Nb: 0.30% or less,
Group B: one or more selected from:
Ti: 0.3% or less,
Zr: 0.3% or less, and
Co: 1.5% or less, and
Group C: one or more selected from:
Ca: 0.01% or less,
REM: 0.3% or less,
Mg: 0.01% or less,
Sn: 0.2% or less, and
Sb: 1.0% or less.

8. The stainless steel seamless pipe according claim 4, wherein the composition further comprises, by mass %, one or more Groups selected from the following Groups A to C:

Group A: one or more selected from:
B: 0.01% or less, and
Nb: 0.30% or less,
Group B: one or more selected from:
Ti: 0.3% or less,
Zr: 0.3% or less, and
Co: 1.5% or less, and
Group C: one or more selected from:
Ca: 0.01% or less,
REM: 0.3% or less,
Mg: 0.01% or less,
Sn: 0.2% or less, and
Sb: 1.0% or less.

9. A method for manufacturing the stainless steel seamless pipe of claim 1, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

10. A method for manufacturing the stainless steel seamless pipe of claim 2, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

11. A method for manufacturing the stainless steel seamless pipe of claim 3, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

12. A method for manufacturing the stainless steel seamless pipe of claim 4, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

13. A method for manufacturing the stainless steel seamless pipe of claim 5, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

14. A method for manufacturing the stainless steel seamless pipe of claim 6, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

15. A method for manufacturing the stainless steel seamless pipe of claim 7, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

16. A method for manufacturing the stainless steel seamless pipe of claim 8, the method comprising:
forming a seamless steel pipe of predetermined dimensions from a steel pipe material;
quenching comprising:
heating the seamless steel pipe to a temperature ranging from 850 to 1,150° C., and
cooling the seamless steel pipe to a surface temperature of 50° C. or less at a cooling rate of air cooling or faster; and
tempering comprising heating the quenched seamless steel pipe to a temperature in a range of 500 to 650° C.

* * * * *